US008485006B2

(12) United States Patent
Kiiski

(10) Patent No.: US 8,485,006 B2
(45) Date of Patent: Jul. 16, 2013

(54) DISC TUMBLER CYLINDER LOCK AND KEY COMBINATION

(75) Inventor: Seppo Kiiski, Joensuu (FI)

(73) Assignee: Abloy Oy, Joensuu (FI)

( * ) Notice: Subject to any disclaimer, the term of this patent is extended or adjusted under 35 U.S.C. 154(b) by 0 days.

(21) Appl. No.: 13/516,595

(22) PCT Filed: Dec. 8, 2010

(86) PCT No.: PCT/FI2010/051006

§ 371 (c)(1),
(2), (4) Date: Jun. 15, 2012

(87) PCT Pub. No.: WO2011/080384

PCT Pub. Date: Jul. 7, 2011

(65) Prior Publication Data

US 2012/0260703 A1 Oct. 18, 2012

(30) Foreign Application Priority Data

Jan. 4, 2010 (FI) ..... 20105001

(51) Int. Cl.
*E05B 29/04* (2006.01)
*E05B 31/00* (2006.01)

(52) U.S. Cl.
USPC ..... 70/366; 70/358; 70/386; 70/389; 70/409; 70/419

(58) Field of Classification Search
USPC ..... 70/365, 366, 386, 419, 389, 429, 70/430, 409, 376, 377, 358, 421, 379 R, 379 A, 70/380
See application file for complete search history.

(56) References Cited

U.S. PATENT DOCUMENTS

| | | | | |
|---|---|---|---|---|
| 3,418,833 | A * | 12/1968 | Kerr | 70/421 |
| 3,742,744 | A * | 7/1973 | Lumme | 70/358 |
| 3,848,442 | A | 11/1974 | Mertanen | |
| 4,446,709 | A * | 5/1984 | Steinbach | 70/496 |
| 4,512,166 | A | 4/1985 | Dunphy et al. | |
| 5,335,520 | A * | 8/1994 | Lee | 70/349 |
| 5,533,369 | A * | 7/1996 | Valdajos-Gallego | 70/493 |
| 5,964,108 | A * | 10/1999 | McBride | 70/38 A |
| 6,799,447 | B2 * | 10/2004 | Mielonen et al. | 70/366 |
| 6,826,936 | B1 * | 12/2004 | Ming-Er et al. | 70/360 |
| 2006/0272372 | A1 * | 12/2006 | Talamonti et al. | 70/358 |
| 2007/0051146 | A1 * | 3/2007 | Recondo Carayalde et al. | 70/409 |

FOREIGN PATENT DOCUMENTS

| | | |
|---|---|---|
| EP | 1 279 788 A1 | 1/2003 |
| FI | 108308 B | 12/2001 |
| GB | 2 266 119 A | 10/1993 |

* cited by examiner

*Primary Examiner* — Lloyd Gall
(74) *Attorney, Agent, or Firm* — Muncy, Geissler, Olds & Lowe, PLLC

(57) ABSTRACT

A combination includes a disc tumbler cylinder lock and key. The disc tumbler cylinder lock of the combination comprises a rotation limiter of the key, and the key comprises guidance surfaces for the rotation limiter. The rotation limiter comprises a frame, which comprises a key profile opening, and a casing, which at least partially surrounds the frame. The frame comprises a limiting mechanism and a locking mechanism, which are disposed in a line such that the limiting mechanism is on the other side of the key profile opening and the locking mechanism is on the opposite side of the key profile opening.

17 Claims, 4 Drawing Sheets

DISC TUMBLER CYLINDER LOCK AND KEY COMBINATION

TECHNICAL FIELD

Figure 1:
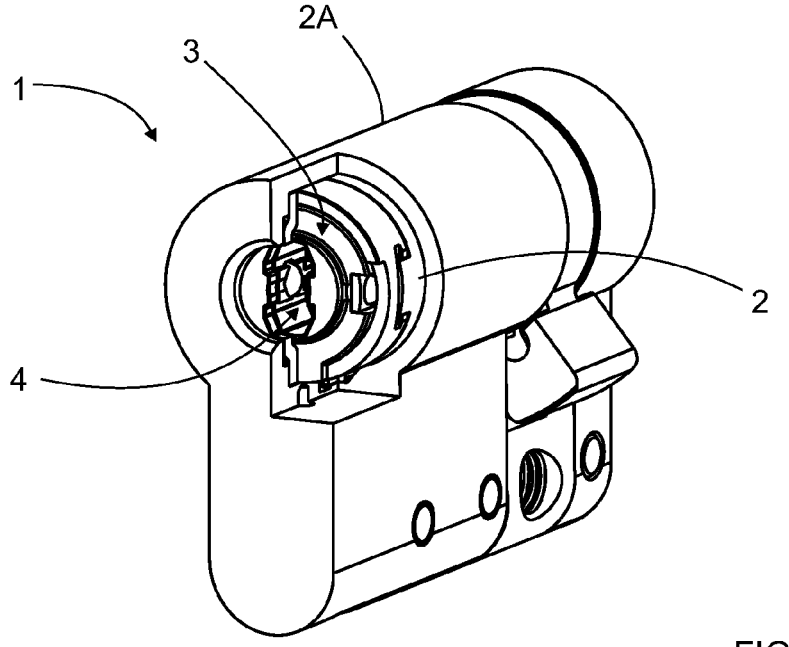

This invention relates to a disc tumbler cylinder lock and key combination. In particular, the invention relates to a combination, the disc tumbler cylinder lock of which is provided with a rotation limiter.

BACKGROUND ART

In disc tumbler cylinder locks, tumbler discs are used to resolve a key-specific code and open the lock. Inserting a key into a disc tumbler cylinder lock does not yet cause the code to be resolved, rather it is the turning of the key that causes turning of the tumbler discs according to the grooves of the key and thus resolution of the key code.

It has been observed that if the key is, for some reason, not fully inserted into a disc tumbler cylinder lock, then turns of the key can, in this case, cause a very slight turning of the tumbler discs away from their common standard position. The standard position means that the key can be inserted into the lock. If some of the tumbler discs have turned a tiny bit from the standard position, then inserting the key into the lock does not go smoothly, it will instead be experienced as difficult or impossible. The key will have to be turned several times from side to side in order to get the key fully into the cylinder lock. To prevent this, disc tumbler cylinder locks are often provided with a rotation limiter.

A rotation limiter is a mechanism, which prevents a key from turning in a disc tumbler cylinder lock, if the key is not fully inserted into the cylinder. The rotation limiter allows a key in a cylinder lock to be turned, when the key is fully inserted into the cylinder. Patent publication FI 108308 presents a known rotation limiter of a disc tumbler cylinder lock. The rotation limiter comprises a frame and a casing. The casing is connected to the inner cylinder of the disc tumbler cylinder lock. In the centre of the frame is a key profile opening, through which the key can be inserted into the cylinder lock. On both sides of the key profile opening is a limiting mechanism in the same line. The limiting mechanism is made up of a spring and balls on both sides of the spring. If the key is not fully inserted into the cylinder lock, the surface of the shaft of the key keeps the balls of the limiting mechanism so close to each other that, if an attempt is made to turn the key, the ball on the casing side is unable to move away from the hollow of the casing. Because the casing is connected to the inner cylinder, which is not able to turn until the key code is fully resolved, a key that is incompletely inserted into the cylinder lock is not able to turn.

The key has counter surfaces for the balls of the limiting mechanism. The counter surfaces are recesses in the surface of the key. When the key is in the correct place in the key cylinder, the ball of the limiting mechanism on the key side is in the recess of the key, and as the key is turned, the ball on the casing side is able to move away from the hollow of the casing. Thus, the key can be turned in order to move the tumbler discs into the correct position for opening the lock. In this case, the inner cylinder is able to turn as turning of the key is continued.

The rotation limiter makes the disc tumbler cylinder lock more functionally reliable. However, it is able to rotate in the cylinder lock, when a key is not inserted into the lock. This rotation facilitates the possible picking of the lock.

BRIEF DESCRIPTION OF THE INVENTION

The object of the invention is a disc tumbler cylinder lock, the rotation limiter of which is not able to rotate, when a key is not in the cylinder lock. The object is achieved in the manner described in the independent claim. The dependent claims describe various embodiments of the invention.

The inventive solution relates to a disc tumbler cylinder lock and key combination. The disc tumbler cylinder lock of the combination comprises rotation limiting means of the key, and the key comprises guidance surfaces for the rotation limiting means. The rotation limiting means comprise a frame, which has a key profile opening and a casing, which at least partially surrounds the frame. The frame comprises a limiting mechanism and a locking mechanism, which are disposed in a line such that the limiting mechanism is on the other side of the key profile opening and the locking mechanism is on the opposite side of the key profile opening.

The locking mechanism comprises a locking pin directed along said line, which comprises, at the end on the casing side, a projection that is transverse in relation to the axis of the locking pin. The projection is arranged, in cooperation with the casing, to prevent the frame from turning, when the key is not in the lock or fully inserted into the lock.

The key of the combination comprises a through hole, in which hole a moving element is disposed. The element is arranged to move In the hole such that it is prevented from moving entirely away from the hole. The surfaces of the moving element, which are visible from the through hole, form said guidance surfaces.

When the key is in the lock for the purpose of opening the lock, the through hole and the moving element are in the same line with the limiting mechanism and the locking mechanism. The limiting mechanism is arranged to push the moving element out from the hole onto the opposite side of the key profile opening and thus to allow the key to turn. The locking mechanism is arranged, in response to the pushing of the moving element, to release the barrier formed by the cooperation of the casing and the projection of the locking pin. Thus, the interacting functionalities of the limiting mechanism, the element of the key and the locking mechanism provide the situation that the rotation limiter is not able to turn, when the key is incompletely inserted into the disc tumbler cylinder lock or it is not in the cylinder at all. Thus, a key inserted incompletely into the lock or an incorrect key inserted into the lock is not able to turn.

Additionally, the duplication of a key is more difficult, when there is a moving element in the key. This complicates the production of illegal copies.

LIST OF FIGURES

Figure 2:
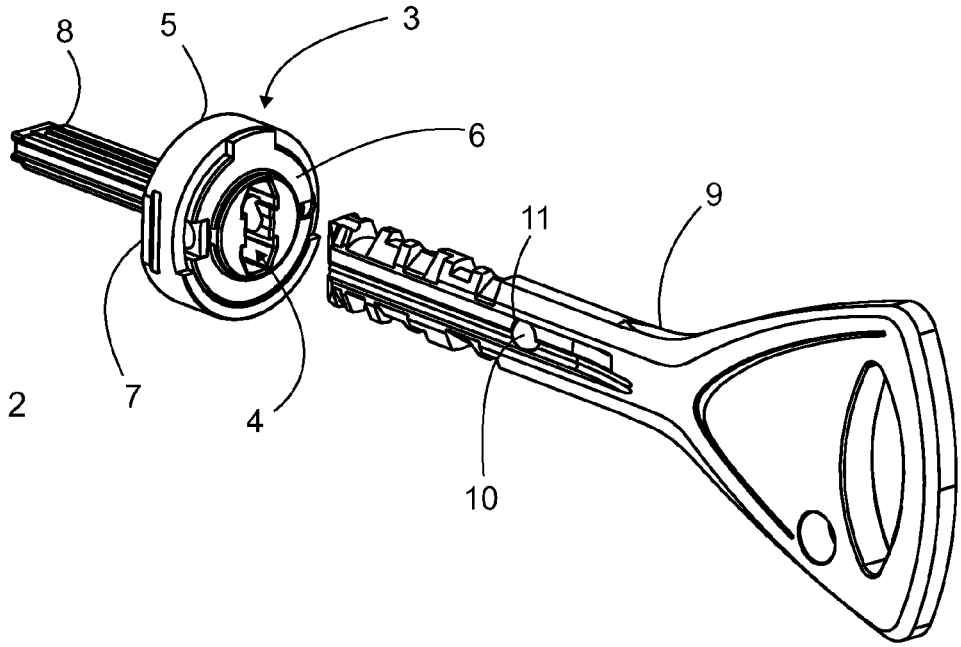
Figure 3:
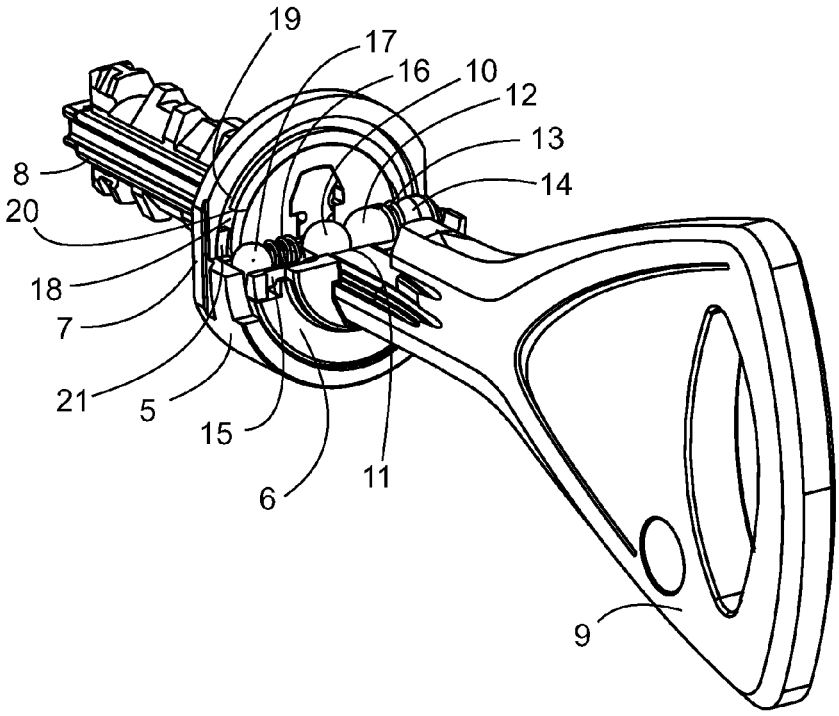
Figure 4:
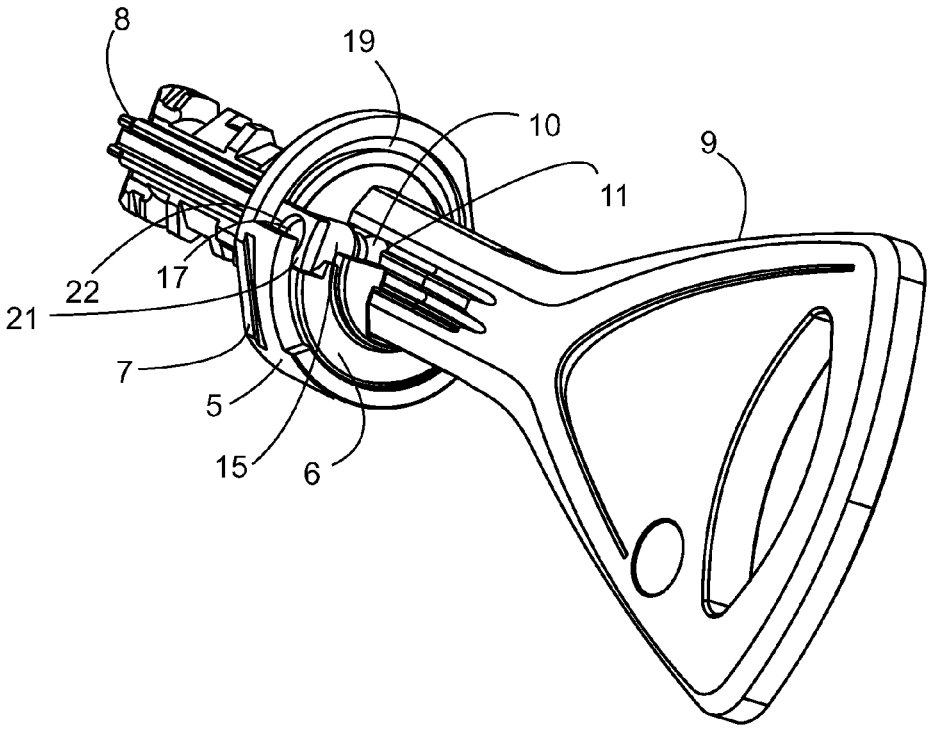
Figure 5:
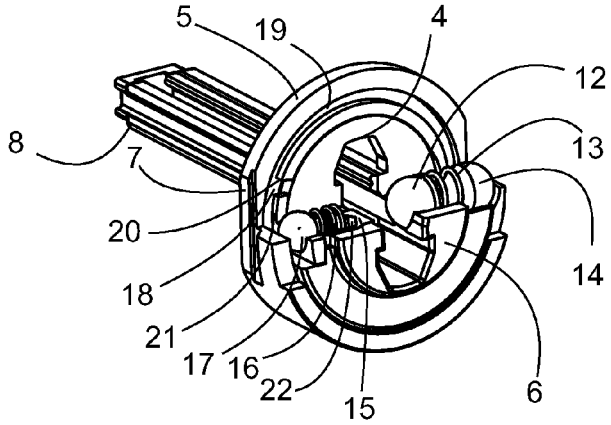
Figure 6:
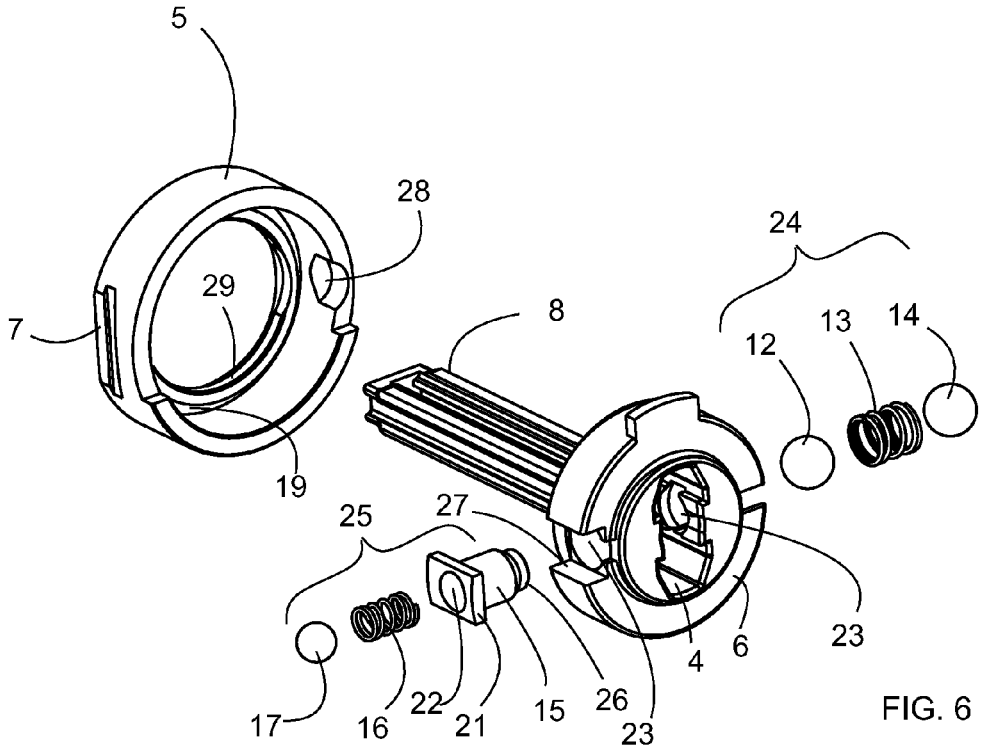
Figure 7:
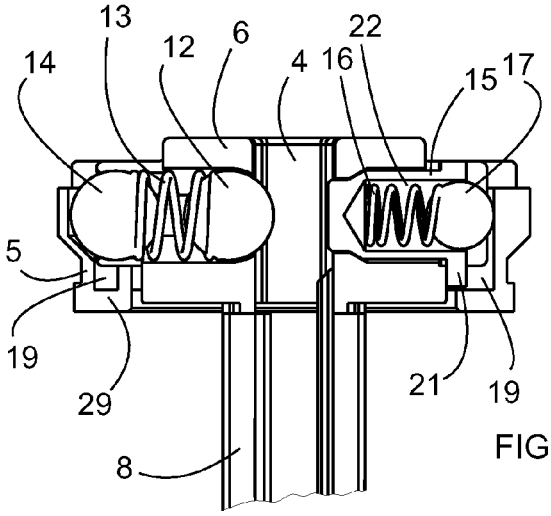
Figure 8:
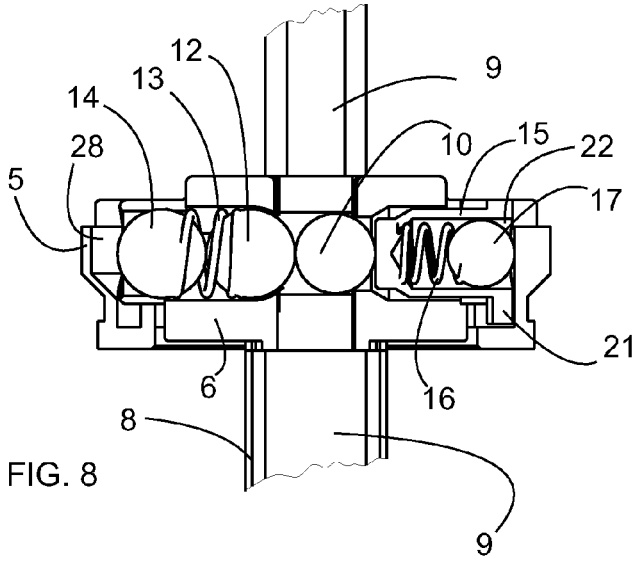

In the following, the invention is described in greater detail with reference to the accompanying figures, in which FIG. 1 shows an example of a disc tumbler cylinder lock according to the invention, FIG. 2 shows an example of a rotation limiter and key according to the invention, FIG. 3 shows the example in FIG. 2 with the key inserted into the rotation limiter, FIG. 4 shows the example in FIG. 3, when the key is turned, FIG. 5 shows a sectional view of the rotation limiter of the example in FIG. 2, FIG. 6 shows an exploded view of the rotation limiter of the example in FIG. 2, FIG. 7 shows another sectional view of the rotation limiter of the example in FIG. 2, and FIG. 8 shows a third sectional view of the rotation limiter and key of the example in FIG. 2.

DESCRIPTION

FIG. 1 shows an example of a disc tumbler cylinder lock according to the invention. The cylinder lock comprises an outer cylinder 2A, into which is inserted an inner cylinder 2 with its tumbler discs. The disc tumbler cylinder lock comprises a rotation limiter 3, which has a key profile opening 4.

FIG. 2 shows an example of a rotation limiter and key according to the invention. The key 9 comprises a through hole 11, in which a moving element 10 is disposed. The edges of the through hole are machined, for example by upsetting, such that the moving element is not able to completely move away from the hole. A preferred embodiment of the moving element is a ball. The moving element can also be, for example, a pin. In this case, remaining of the moving element in the through hole can also be arranged by other means than by machining the edges. Those surfaces of the moving element, which are visible from the through hole, are guidance surfaces. The guidance surfaces are seated against the locking mechanism and the limiting mechanism of the rotation limiting means, when the key is fully inserted into the disc tumbler cylinder lock.

The rotation limiter (rotation limiting means) is made up of a casing 5 and a frame 6. The frame comprises a key profile opening 4, a limiting mechanism 24 (see FIG. 6) and a locking mechanism 25. The limiting mechanism and the locking mechanism are disposed in a line such that the limiting mechanism is on one side of the key profile opening 4 and the locking mechanism is on the opposite side of the key profile opening. The structure and function of the limiting mechanism 24 and the locking mechanism 25 are shown in FIGS. 3-8. The frame 6 and the casing 5 are connected to each other through the locking mechanism such that the frame is not able to turn in relation to the casing other than when the key 9 is fully inserted into the disc tumbler cylinder lock. The casing at least partially surrounds the frame. The casing has attachment surfaces 7, with which the rotation limiter can be connected to the inner cylinder 2 of the cylinder lock. The attachment surfaces of the casing can be implemented in several different manners. FIG. 2 shows one manner, and FI 108308 shows another manner. One preferred embodiment of the rotation limiter comprises a guidance element 8 connected to the rotation limiter.

The structure of the rotation limiter is shown in greater detail in FIGS. 5 and 6. The function and structure are shown in FIGS. 3, 4, 7 and 8.

FIG. 5 shows a sectional view of the rotation limiter of the example in FIG. 2. FIG. 6 shows an exploded view of the rotation limiter of the example in FIG. 2. The frame 6 of the rotation limiter can be formed from one or several parts. The frame has borings 23, in which the limiting mechanism 24 and the locking mechanism 25 are disposed. The limiting mechanism 24 comprises in a known manner two balls 12, 14 and a spring 13 between the balls. One of the balls 14 lies against the casing 5. The casing has a hollow 28 for the ball. If the key is not in the cylinder lock or it is fully inserted into the cylinder lock, then the ball on the casing side is able to move away from the hollow 28 of the casing as the key is turned or otherwise as the rotation limiter is turned (if there were no locking mechanism). The limiting mechanism and the locking mechanism are in the same line on different sides of the key profile opening 4.

The locking mechanism 25 comprises a locking pin 15 directed along said line, which locking pin comprises, at the end of the casing side, a projection 21, which is transverse in relation to the axis of the locking pin. The projection is arranged, in cooperation with the casing, to prevent the frame from turning, when the key is not in the lock or not fully inserted into the lock.

The frame has a cut 27 at the site of the projection 21 of the locking pin to allow the movement of the locking pin in the direction of the line. The casing has a groove 19 and a cut 18. The cut 18 is at the site of the locking pin to allow the moving of the projection 21 of the locking pin to the site of the groove 19. At least one surface of the cut is a barrier surface 20. The barrier surface and projection work in cooperation to prevent the frame from turning, when the projection is at the site of the barrier surface. The gap between the barrier surface and the projection is shown as relatively large in FIG. 5. It is obvious that this gap can be smaller.

The basic shape of the casing 5 is a ring. The casing comprises an indented collar 29, i.e. the collar is a projection on the inner surface of the ring. Said groove and cut are located in the collar. The groove (as well as the collar) are at least at the site of the turning sector of the key. By turning sector is meant the turning area of the key, where the key code is resolved in a cylinder lock. From a production viewpoint, a preferred embodiment is that the groove 19 and collar 29 form a complete circle on the inner surface of the casing. The frame 6 is placed into the casing 5 such that the casing at least partially covers the edge area of the frame. From the figures, it can be stated that the frame and casing are mainly circular in shape.

The locking mechanism 25 comprises a flexible element 16 to push the locking pin toward the key profile opening 4. The flexible element is placed between the casing 5 and the locking pin. It is preferred that the locking pin has a recess 22, in which the flexible element can be placed. This facilitates assembly of the rotation limiter. It is also preferred that between the flexible element 16 and the casing is located a ball 17. The ball makes the use of the rotation limiter more pleasant and functionally reliable in comparison to a locking mechanism without a ball.

A spring structure is a preferred embodiment for the flexible element. In the embodiment shown in the figures, the projection 21 of the locking pin is a locking plate. The projection can also have some other form, for example that of a pin, which is directed toward the collar of the casing.

As was stated above, in the through hole 11 of the key 9 is disposed a moving element 10, which is arranged to move in the hole. When the key is in the lock for the purpose of opening the lock, or more specifically in the cylinder lock, the through hole 11 and the moving element 10 are in the same line with the limiting mechanism 24 and the locking mechanism 25. FIG. 7 shows a sectional view of the rotation limiter, when the key is not in the cylinder lock. FIGS. 3 and 8 show sectional views, when the key is in the cylinder lock (and thus also in the rotation limiter). In FIG. 8, the key is slightly turned.

When the key is not in the cylinder lock, the projection 21 of the locking pin 15 is not at the site of the groove 19. This also holds true, when the key is only incompletely inserted into the cylinder lock. The locking pin 15 is arranged in the frame of the rotation limiter such that that it is not able to be pushed into the key profile opening 4, as it would otherwise prevent a key from being inserted into the cylinder lock. The head 26 of the locking pin and the boring 23 of the frame at the end of the key profile opening could have been formed as narrower than the other part of the locking pin and the boring.

When the key is in the lock, the limiting mechanism 24 is arranged to push the moving element 10 out of the hole 11 onto the opposite side of the key profile opening 4. The ball 12 of the limiting mechanism on the key profile opening side pushes the moving element 10. The moving element, for its part, moves toward the locking pin 15, which moves in the direction of the casing against the flexible element. The moving of the locking pin in the direction of the casing moves the projection 21 of the locking pin to the site of the groove 19 of the casing. FIG. 8 shows this situation. When the projection is at the site of the groove, the key can be turned. In FIG. 8, the key 9 is slightly turned, wherein the ball 14 of the limiting mechanism on the casing side has risen up away from the hollow 28 of the casing. FIG. 4 also illustrates, how a projection of the locking pin that has moved to the site of the groove enables turning of the key. When the key is removed from the cylinder lock, the flexible elements of the limiting mechanism and the locking mechanism return the rotation limiter to the state described above, in which the key is not in the cylinder.

The rotation limiter is therefore not able to turn (at the most only slightly due to tolerances of the parts), when the key is not in the cylinder lock. This makes possible attempts to pick open the cylinder lock (and lock) more difficult, as the rotation limiter thus forms an additional barrier and also limits the use of space.

It is obvious that the invention is not limited to the examples mentioned in this text only, rather the invention can be implemented by a plurality of various embodiments within the scope of the presented claims.

The invention claimed is:

1. A disc tumbler cylinder lock and key combination, in which the disc tumbler cylinder lock comprises rotation limiting means, and the key comprises guidance surfaces for the rotation limiting means, which rotation limiting means comprise a frame, which comprises a key profile opening, and a casing, which at least partially surrounds the frame, wherein the frame comprises a limiting mechanism and a locking mechanism, which are disposed in a line such that the limiting mechanism is on one side of the key profile opening and the locking mechanism is on an opposite side of the key profile opening, which locking mechanism comprises a locking pin directed along said line, which locking pin comprises, at an end of the locking pin adjacent the casing, a projection that is transverse in relation to the axis of the locking pin, which projection is arranged, in cooperation with the casing, to prevent the frame from turning, when the key is not in the disc tumbler cylinder lock or not fully inserted into the disc tumbler cylinder lock, which key comprises a through hole, in which hole is disposed a moving element, which is arranged to move in the hole such that it is prevented from moving completely away from the hole, wherein the surfaces of the moving element form said guidance surfaces, in which combination, when the key is in the disc tumbler cylinder lock for the purpose of opening the lock, the through hole and moving element are in the same line with the limiting mechanism and the locking mechanism, and which limiting mechanism is arranged to push the moving element out of the hole onto the opposite side of the key profile opening, and to allow turning of the key, and which locking mechanism is arranged, in response to the pushing of the moving element, to release a barrier formed by the cooperation of the casing and the projection of the locking pin.

2. The combination according to claim 1, wherein the frame has a cut at the site of the projection of the locking pin to allow the movement of the locking pin in the direction of the line, and the casing has a groove and a cut, which cut is at the site of the locking pin to allow moving of the projection of the locking pin to the site of the groove, of which cut at least one surface is a barrier surface, which barrier surface and projection work in cooperation to prevent turning of the frame.

3. The combination according to claim 2, wherein the casing comprises an indented collar, in which said groove and cut are located, which groove is at least at the site of a turning sector of the key.

4. The combination according to claim 3, wherein the locking mechanism comprises a flexible element to push the locking pin toward the key profile opening.

5. The combination according to claim 4, wherein the locking pin has a recess, into which the flexible element is installed.

6. The combination according to claim 5, wherein between the flexible element and the casing is located a ball.

7. The combination according to claim 4, wherein the flexible element is a spring.

8. The combination according to claim 7, wherein the projection of the locking pin is a locking plate.

9. The combination according to claim 4, wherein the projection of the locking pin is a locking plate.

10. The combination according to claim 4, wherein the frame has borings for said limiting mechanism and locking mechanism.

11. The combination according to claim 10, wherein the flexible element is a spring and the projection of the locking pin is a locking plate.

12. The combination according to claim 4, wherein, in their basic shape, the frame and the casing form a ring.

13. The combination according to claim 1, wherein the moving element disposed in the key is a ball.

14. The combination according to claim 7, wherein the moving element disposed in the key is a ball.

15. The combination according to claim 8, wherein the moving element disposed in the key is a ball.

16. The combination according to claim 1, wherein the limiting mechanism comprises a spring, with a ball at both of its ends, and the casing of the rotation limiting means has a hollow for one ball of the limiting mechanism.

17. The combination according to claim 16, wherein a guidance element is connected to the rotation limiting means.

* * * * *